United States Patent [19]

De Fusco

[11] 4,232,832

[45] Nov. 11, 1980

[54] ATOMIZER DEVICE

[75] Inventor: Joseph De Fusco, St. Gall, Switzerland

[73] Assignee: Gema AG, Switzerland

[21] Appl. No.: 973,112

[22] Filed: Dec. 26, 1978

[30] Foreign Application Priority Data

Dec. 23, 1977 [CH] Switzerland ..... 15997/77

[51] Int. Cl.[3] ..... B05B 5/00; B05B 7/12

[52] U.S. Cl. ..... 239/707; 239/417.5

[58] Field of Search ..... 239/405, 406, 424.5, 239/704, 706, 417.3, 598, 417.5, 707

[56] References Cited

U.S. PATENT DOCUMENTS

| | | | |
|---|---|---|---|
| 3,233,831 | 2/1966 | Fraser | 239/405 X |
| 3,979,069 | 9/1976 | Garofalo | 239/406 X |
| 4,105,163 | 8/1978 | Davis | 239/406 |
| 4,139,157 | 2/1979 | Simmons | 239/406 X |
| 4,159,082 | 6/1979 | Luderer et al. | 239/417.5 X |

*Primary Examiner*—Robert B. Reeves
*Assistant Examiner*—Gene A. Church
*Attorney, Agent, or Firm*—Ostrolenk, Faber, Gerb & Soffen

[57] ABSTRACT

The disclosure concerns an atomizer head used for atomizing wet lacquer, or the like. The atomizer head has an air conduit communicating with an air outlet part and has a liquid conduit communicating with a liquid outlet part. The air outlet part is radially outside the liquid outlet part. There is an inner part of the atomizer head which adjoins the outlet end of the liquid conduit. The inner part has an outside which is preferably trumpet shaped. The liquid conduit outlet end communicates with the outside of the inner part through obliquely extending ducts. There is an intermediate part that is outside the outlet end of the liquid conduit and outside the inner part. A cap is positioned outside the intermediate part. The air conduit is in part defined between the intermediate part and the cap. The intermediate part has a peripheral flange which is engaged by the interior of the cap. The flange has grooves extending along it for passage of air. The flange is in the air conduit. The flange tapers narrower toward the air outlet part. The grooves may be longitudinally extending along the flange or may be helically wound about the flange. A cap nut holds the cap to the atomizer head.

10 Claims, 8 Drawing Figures

ATOMIZER DEVICE

BACKGROUND AND SUMMARY OF THE INVENTION

The present invention relates to an atomizer device, particularly for wet lacquer, having an atomizer head which has an outlet part for air and an outlet part for the liquid which is to be atomized. A conduit for the liquid is provided which terminates in said outlet part for the liquid.

Such devices are already known. One of the disadvantages of these devices is that the particle density of the atomized liquid cannot be varied within wide limits. Another disadvantage of the known devices of this type is that they cannot be easily taken apart and reassembled when they must be cleaned after use.

The object of the present invention is to eliminate these and still other disadvantages of the device of this type. This is done, in the case of the device of the invention, in the manner that an inner part of the atomizer head adjoins the outlet end of the liquid conduit and that the inside of the liquid conduit is connected by obliquely extending ducts with the outside of the said inner part.

BRIEF DESCRIPTION OF THE DRAWINGS

Several embodiments of the present invention will be explained in further detail below, with reference to the accompanying drawings in which.

DESCRIPTION OF THE PREFERRED EMBODIMENTS

Figure 1:
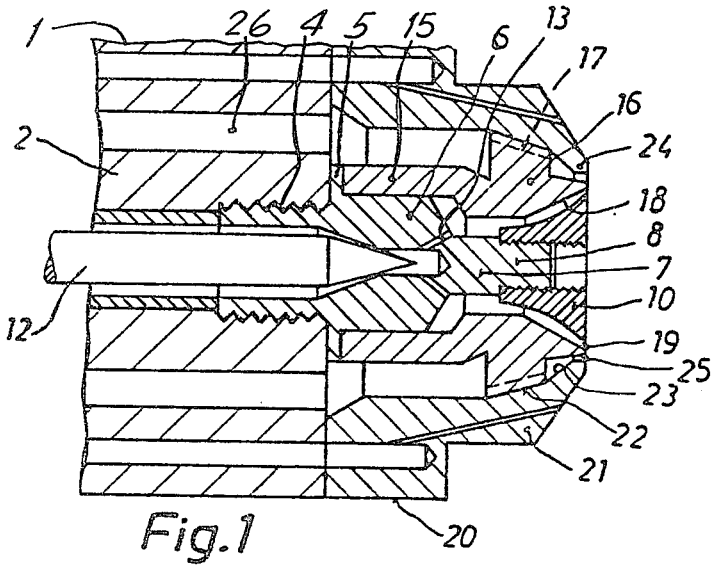
FIG. 1 is a longitudinal section through a first embodiment of the atomizer head of the present atomizer device.

FIG. 1 shows only the adapter 1 of the spray gun (not shown) which has an atomizer head.

Figure 3:
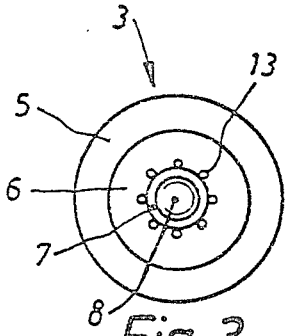
FIG. 3 is a front view of the inner part of FIG. 2.
Figure 2:
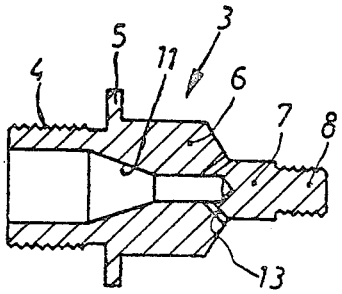
FIG. 2 is a longitudinal section through the inner part of the head of FIG. 1.

In the center of the adapter 1 there is a conduit 2 for the liquid to be atomized. The end (not shown) of this conduit 2 is connected in known manner to a supply container for the liquid to be atomized. In the end of the liquid conduit 2 which is shown in FIG. 1 there is screwed an end piece 3 which is also shown in FIGS. 2 and 3. This end piece 3 has a threaded portion 4 which is screwed into the liquid conduit 2. The threaded portion 4 passes into a collar 5 adjoining which is a central part 6 of the end piece 3. The end piece 3 is furthermore provided with a forward extension 7 which terminates in a threaded piece 8. On the threaded piece 8 there is screwed a deflecting plate 10. The outer wall of plate 10 widens forwardly in trumpet shape.

The end piece 3 is hollow. A constriction 11 is provided in the region of the central part 6 thereof. This constriction forms a valve seat. Within the conduit 2 there is a valve needle 12. The end of the needle 12 (not shown) is fastened in a known device (not shown) for the axial adjustment of the valve needle.

The constricted portion of the hollow space within the end piece 3 is connected by obliquely outwardly extending ducts 13 with the outside of the extension 7 which represents an inner part of the atomizer head.

Figure 5:
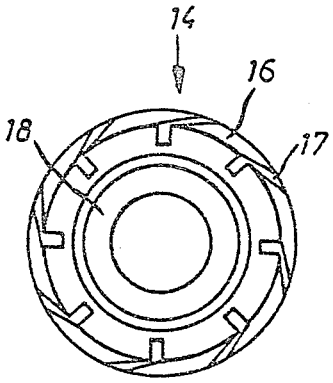
FIG. 5 is a front view of the intermediate part shown in FIG. 4.
Figure 4:
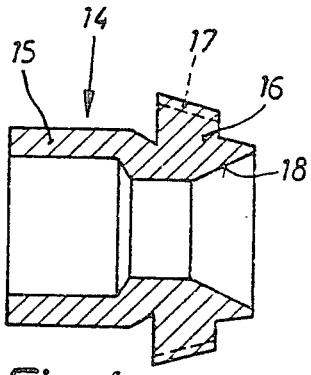
FIG. 4 is a longitudinal section through an intermediate part of the head shown in FIG. 1.

On the central part 6 of the end piece 3 there is placed an intermediate part 14 having a continuous opening, which part is shown on a larger scale in FIGS. 4 and 5. The intermediate part 14 has a cylindrical portion 15 which sits firmly on and around the central part 6. In front of this portion 15 there is a flange 16 the circumferential portion of which is provided with longitudinally extending grooves 17. As can be noted from FIG. 5, the grooves 17 extend outwardly obliquely to the axis of symmetry of the intermediate part 14. The mouth 18 of the continuous opening in the intermediate part 14 widens outward in conical shape so that between said mouth 18 and the widening surface of the deflecting plate 10 there is produced a slot 19 through which the liquid can emerge.

The intermediate part 14 is surrounded by an outer part 20 which can be fastened to the adapter 1 in any known manner. The outer part 20 has a cap-shaped section 21. The inner wall of this section 21 has a conically shaped portion 22 which rests on the circumference of the flange 16 of the intermediate part 14. The further tapering portion 23 of the inner wall of the slot 21 passes into a lip 24. Between this lip 24 and the wall of the mouth 18 of the intermediate part 14 there is produced a second slot 25 through which air which is fed through air ducts 26 in the adapter 21 can emerge. The air flows through the obliquely extending grooves 17 in the flange 16 so that it emerges from the second slot 25. At this place this air also comes against the liquid emerging from the first slot 19 and an intensive atomization of this liquid takes place here.

Figure 6:
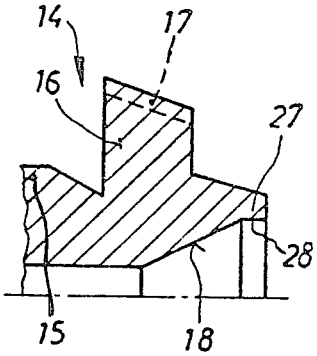
FIG. 6 shows a portion of another embodiment of the intermediate part, seen in longitudinal section.

In FIG. 6 a modified embodiment of the intermediate part 14 is shown. The difference from FIG. 4 is that the front end of the intermediate part 14 has an extension 27 with a cylindrical inner wall 28. This inner wall 28 limits the diameter of the jet of atomized liquid.

Figure 7:
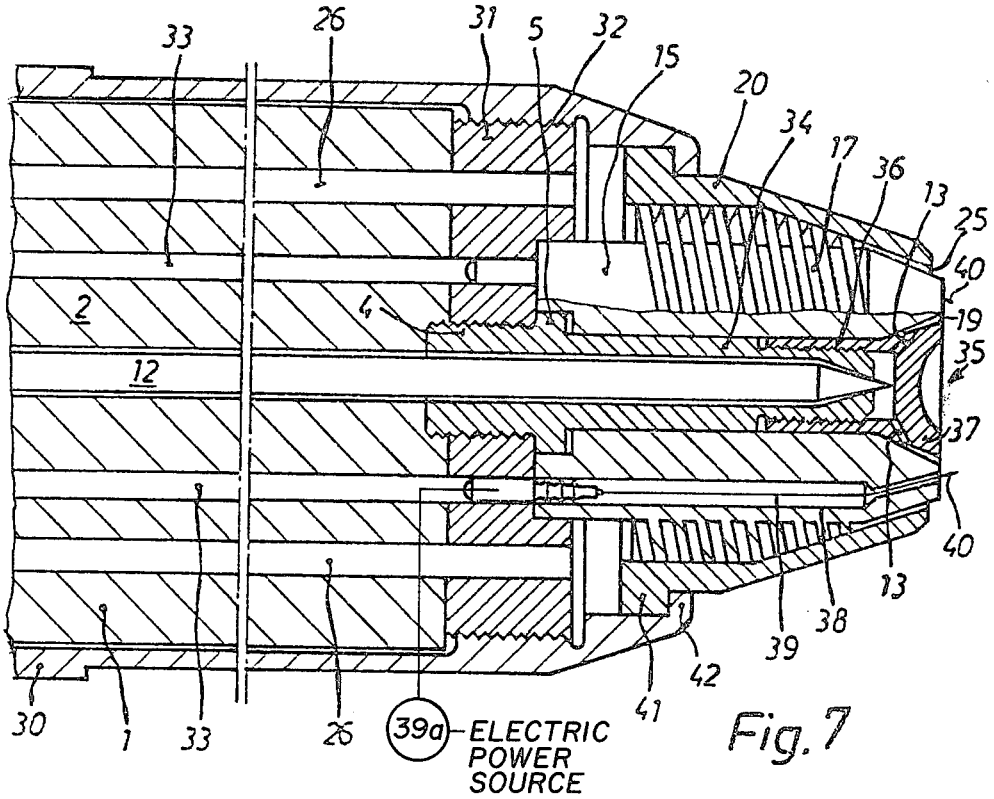
FIG. 7 is a longitudinal section through a second embodiment of the atomizer head of the present atomizer device.

FIG. 7 shows a second embodiment of the present device. This FIG. 7 again shows the adapter 1 of a spray gun which is extensively covered by a long cap nut 30. On the front side of the adapter 1 there is arranged a front plate 31 whose peripheral surface is provided with a thread 32 with which the internal thread of the cap nut 30 is in engagement. The air ducts 26, channels 33 for high voltage lines, as well as a liquid conduit 2 and the valve needle 12 extend through the front plate 31.

The end piece of the liquid conduit 2 again has a threaded portion 4 which is screwed in the front plate 31 and in part also in the conduit 2. However, in front of the collar 5 there is a merely cylindrical portion 34 whose front end bears an outer thread.

A liquid distributor 35 is provided which has a portion 36, also cylindrical with an inner thread and a deflecting plate 37. The cylindrical portion 36 of the liquid distributor 35 is screwed onto the free end of the end 34 piece. The liquid distributor 35 has obliquely outward extending ducts 13 which connect the inside of the liquid conduit 2 with the outside of the deflecting plate 37, which represents the inner part of the atomizer head.

The intermediate part of the atomizer head again has a cylindrical portion 15 which is seated on the cylindrical portion 34 of the end piece. In the intermediate part 15 there are also developed ducts 38 for the passage of high voltage lines 39 to which atomizer electrodes 40 are connected.

The electrodes 40 extend past the outwardly facing side of the deflecting plate 37. Furthermore, because they pass through the intermediate part, they are also disposed between the liquid slot 19 and the air exit slot 25. The high voltage line 39 is connected with a power source 39*a*.

The grooves 17 in the flange of the intermediate part 14 are developed in the shape of a multi-start thread. Accordingly, the air emerging from the second slot 25 has a strong tangential component imparted to it of velocity, whereby an intensive atomization of the liquid emerging from the slot 19 takes place.

Figure 8:
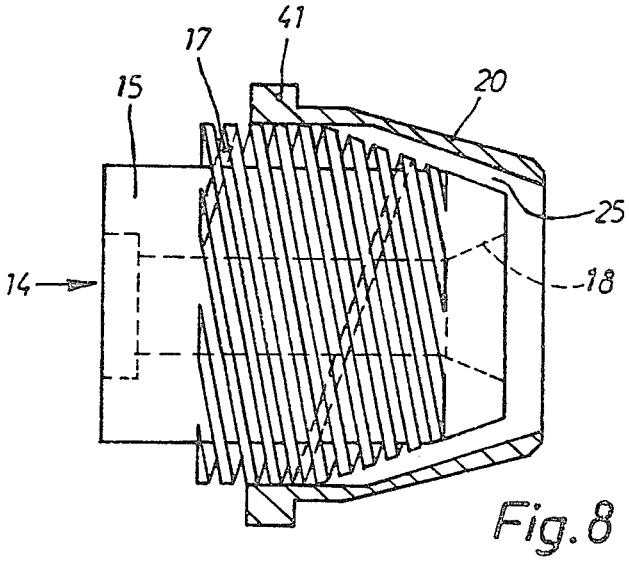
FIG. 8 shows a detail of the head shown in FIG. 7.

The outer part 20 is provided on its rear end with a flange 41 on which an annular shoulder 42 of the cap nut 30 acts. By turning the cap nut 30, axial displacement of the cap-shaped outer part 20 can be brought about so that the outlet slot 25 for the air is increased or decreased. FIG. 8 shows the case in which the cap 20 is pushed relatively far forward, so that a relatively large slot 25 is produced.

Upon the forward screwing of the cap nut 30 and of the cap 20, the angle of the jet becomes greater. The air flows through the hollow space, strikes against the inner walls of the air cap 20, and flows further in spiral form with continuously decreasing jet diameter towards the outlet 25. The spiral jet also entrains the liquid which comes through the slot 19. The jet can, as desired, be deformed or corrected by an air choke (not shown) which can be installed on the body of the gun adapter 1 or on the handle of the spray gun. For an automatic system, the choke can also be mounted in the control cabinet.

The individual parts of the present invention are made of plastic if an electrostatic system is concerned. In all other cases they may consist of metal.

The predividing of the liquid (lacquer) in ducts 13 leads to a substantially improved atomization via the corresponding deflecting plate and thus again to an improved electrostatic charging of the individual particles of liquid. By displacement of the cap 20, the density of the particles of the atomized liquid can be varied within wide limits.

The adapter 1 of the spray gun may be hollow, and multiplier cascades which produce the high voltage fed to the electrodes 40 can be located in said hollow space.

I claim:

1. Atomizer device, for wet lacquer, or the like coating materials, comprising:

an atomizer head having an air outlet part for air and having a liquid outlet part for liquid; a liquid conduit which terminates at an outlet end located in said liquid outlet part;

said atomizer head having an inner part which adjoins said outlet end of said liquid conduit; said inner part having an outside;

ducts communicating from said liquid conduit outwardly to said inner part outside, whereby said liquid conduit outlet end communicates with said inner part outside;

a hollow intermediate part surrounding said outlet end of said liquid conduit and said inner part; said air outlet part being radially outside said intermediate part; said inner part having an outlet end extending generally in the direction of exit of air through said air outlet part and liquid through said liquid outlet part; said inner part outside widening toward said outlet end of said inner part; between said intermediate part and said widened portion of said inner part outside, an outlet slot for liquid is defined;

at least one electrode passing through said intermediate part and projecting out of said intermediate part and beyond said liquid conduit outlet end and also projecting from said intermediate part between said liquid conduit outlet end and said air outlet part.

2. The atomizer device according to claim 1, wherein said atomizer device includes an air conduit which terminates in said air outlet part; said intermediate part having an outer periphery and having a flange defined on said outer periphery; said flange being located in said air conduit; said flange having a peripheral surface;

a cap outside said flange and being shaped for engaging said peripheral surface of said flange, grooves passing through said flange along the length of said air conduit.

3. The atomizer device according to claim 2, wherein said flange peripheral surface is conically tapering, tapering narrower toward said air outlet part; said cap also tapering narrower for engaging said peripheral surface of said flange.

4. The atomizer device of claim 3, wherein said grooves are also oriented so that each is, at least in part, in a plane that is located at an angle to the longitudinal axis of said atomizer head.

5. The atomizer device according to claim 2, wherein said grooves extend helically around said flange.

6. The atomizer device of claim 1, wherein said inner part is screwed onto said liquid conduit; said obliquely extending ducts being located in said inner part.

7. The atomizer device of claim 2, further comprising a cap nut in engagement with said cap for mounting said cap to said atomizer head and for adjusting the position of said cap on said atomizer head.

8. The atomizer device according to claim 1, wherein said ducts extend obliquely outwardly from said liquid conduit to said inner part outside.

9. The atomizer device according to claim 8, wherein said liquid conduit outlet end and said inner part are formed in a single piece, and said oblique ducts are formed in said single piece.

10. The atomizer device according to claim 9, wherein said inner part has an outlet end extending generally in the direction of exit of air through said air outlet part and liquid through said liquid outlet part; said inner part outside further comprises a deflecting plate located at the outlet end of said inner part; said inner part outside widens like a trumpet, toward said outlet end of said inner part.

* * * * *